US011684535B1

(12) United States Patent
Jiang

(10) Patent No.: US 11,684,535 B1
(45) Date of Patent: Jun. 27, 2023

(54) WALKER HANDLE FOR PARKINSON'S PATIENTS AND WALKER FOR PARKINSON'S PATIENTS

(71) Applicant: Yuyao Jiang, Menlo Park, CA (US)

(72) Inventor: Yuyao Jiang, Menlo Park, CA (US)

( * ) Notice: Subject to any disclaimer, the term of this patent is extended or adjusted under 35 U.S.C. 154(b) by 0 days.

(21) Appl. No.: 18/161,068

(22) Filed: Jan. 29, 2023

(51) Int. Cl.
*A45B 3/00* (2006.01)
*A61H 3/00* (2006.01)

(52) U.S. Cl.
CPC ..... *A61H 3/00* (2013.01); *A61H 2003/007* (2013.01)

(58) Field of Classification Search
CPC ..... A61H 3/00; A61H 3/04; A61H 3/0277; A61H 2003/0283; A45B 9/02
See application file for complete search history.

(56) References Cited

U.S. PATENT DOCUMENTS 5,657,783 A * 8/1997 Sisko ..... A61H 3/00 135/73
9,763,839 B2 * 9/2017 Morris ..... A61G 5/14
10,667,980 B2 * 6/2020 Shen ..... G05D 1/0246

FOREIGN PATENT DOCUMENTS

WO WO-2017104847 A1 * 6/2017 ..... A61B 5/1036

* cited by examiner

*Primary Examiner* — Noah Chandler Hawk
(74) *Attorney, Agent, or Firm* — Westbridge IP LLC

(57) ABSTRACT

Disclosed is a walker handle for Parkinson's patients. The walker handle for Parkinson's patients includes a handle and a connecting base, two ends on both sides of the handle are vertically extended with a connecting rod, and the connecting base is for being installed on a walker body, the connecting base is provided with an accommodating chamber, and the accommodating chamber is filled with a buffer, the connecting base is provided with a connecting port communicating with the accommodating chamber toward the handle, and the connecting rod passes through the connecting port and is wrapped by the buffer.

9 Claims, 2 Drawing Sheets

WALKER HANDLE FOR PARKINSON'S PATIENTS AND WALKER FOR PARKINSON'S PATIENTS

TECHNICAL FIELD

The present disclosure relates to the technical field of walkers, particularly relates to a walker handle for Parkinson's patients and a walker for Parkinson's patients.

BACKGROUND

Parkinson's disease, also known as paralysis agitans, is a chronic disease of the central nervous system that affects the patient's moving ability, which mostly occurs in middle-aged and older people. The main manifestations of the disease in the early stage include static tremor, muscle rigidity, slow movement, difficulty in starting movements and abnormal posture. Static tremor is an uncontrollable shaking of a patient's hands or arms that occurs at rest or worsens with emotional stress.

At present, the walker can be supported by equipment, so that elderly patients with inconvenient legs and feet and the elderly patients who even lose the ability to walk can take care of themselves and go out for a walk like normal people. However, there are no special walkers or walker handles for Parkinson's patients, walkers cannot meet the activity needs of Parkinson's patients, and Parkinson's patients are easy to tremor when using the walkers, which may cause damage to muscle.

SUMMARY

The main objective of the present disclosure is to provide a walker handle for Parkinson's patients and a walker for Parkinson's patients, which aims to solve the technical problem that the Parkinson's patients are easy to tremor when using the walkers, which may cause damage to muscle.

To realize the above objective, the present disclosure provides a walker handle for Parkinson's patients, including:

a handle, two ends on both sides of the handle are vertically extended with a connecting rod;

a connecting base installed on a walker body, the connecting base is provided with an accommodating chamber, the accommodating chamber is filled with a buffer;

the connecting base is provided with a connecting port communicating with the accommodating chamber toward the handle, and the connecting rod passes through the connecting port and is wrapped by the buffer.

In an embodiment, the walker handle further includes a plastic piece, the plastic piece is provided between an inner wall of the connecting base and an outer wall of the buffer, and a plurality of springs are connected between an outer wall of the plastic piece and the inner wall of the connecting base.

In an embodiment, an accommodation space is enclosed between the outer wall of the plastic piece and the inner wall of the connecting base, and a plurality of the springs are evenly distributed in the accommodation space.

In an embodiment, the walker handle further includes a pressure sensor and a display unit, the pressure sensor is provided between the outer wall of the plastic piece and the inner wall of the connecting base and is away from a side of the connecting rod, and the pressure sensor is configured to detect a pressure of the connecting rod on the plastic piece;

the display unit is connected with the pressure sensor, and the display unit is configured to display a pressure value detected by the pressure sensor.

In an embodiment, the buffer is a back-stick sponge, and the sticking surface of the back-stick sponge is glued to an inner wall of the plastic piece.

In an embodiment, the connecting rod comprises a connecting block and a limiting block, the connecting block is connected with the limiting block, and the limiting block is provided in a spherical shape.

In an embodiment, the walker handle further includes a bandage, and two ends of the bandage are connected to the handle, and the bandage is configured to tie a human hand to the handle.

In an embodiment, the bandage is an elastic bandage, and two ends of the elastic bandage are connected with the handle to form a deformable space.

In an embodiment, the connecting base is provided with a screw hole, and the screw hole is used for a screwing bolt to install the connecting base on the walker body.

The present disclosure further provides a walker for Parkinson's patients, the walker includes a walker handle for Parkinson's patients and a walker body, the walker handle is installed on the walker body, and the walker handle includes:

a handle, two ends on both sides of the handle are vertically extended with a connecting rod;

a connecting base installed on a walker body, the connecting base is provided with an accommodating chamber, the accommodating chamber is filled with a buffer;

the connecting base is provided with a connecting port communicating with the accommodating chamber toward the handle, and the connecting rod passes through the connecting port and is wrapped by the buffer.

In an embodiment, the walker handle further includes a plastic piece, the plastic piece is provided between an inner wall of the connecting base and an outer wall of the buffer, and a plurality of springs are connected between an outer wall of the plastic piece and the inner wall of the connecting base.

The technical solution of the present disclosure includes a handle, two ends on both sides of the handle are vertically extended with a connecting rod; a connecting base installed on a walker body, the connecting base is provided with an accommodating chamber, the accommodating chamber is filled with a buffer; the connecting base is provided with a connecting port communicating with the accommodating chamber toward the handle, and the connecting rod passes through the connecting port and is wrapped by the buffer. As provided in this way, when the walker needs to be used, the walker handle can be installed on the walker. Parkinson's patients hold the handle with their hands, when the Parkinson's patient's hand trembles, the connecting rod on the handle is pressed down, and the connecting rod transmits the pressure to the buffer, due to the effect of the buffer, the buffer will transform the tremor from all directions of the handle into an elastic cushion, and the buffer is compressed and deformed, so that the reaction force transmitted to the trembling hand of the Parkinson's patient can be offset by the cushion, so that the reaction force of the tremor minimizes the muscle damage of the Parkinson's patient.

BRIEF DESCRIPTION OF THE DRAWINGS

In order to more clearly illustrate the technical solutions in the embodiments of the present disclosure or in the related art, drawings used in the embodiments or in the related art will be briefly described below. Obviously, the drawings in the following description are only some embodiments of the present disclosure. It will be apparent to those skilled in the art that other figures can be obtained according to the structures shown in the drawings without creative work.

Figure 1:
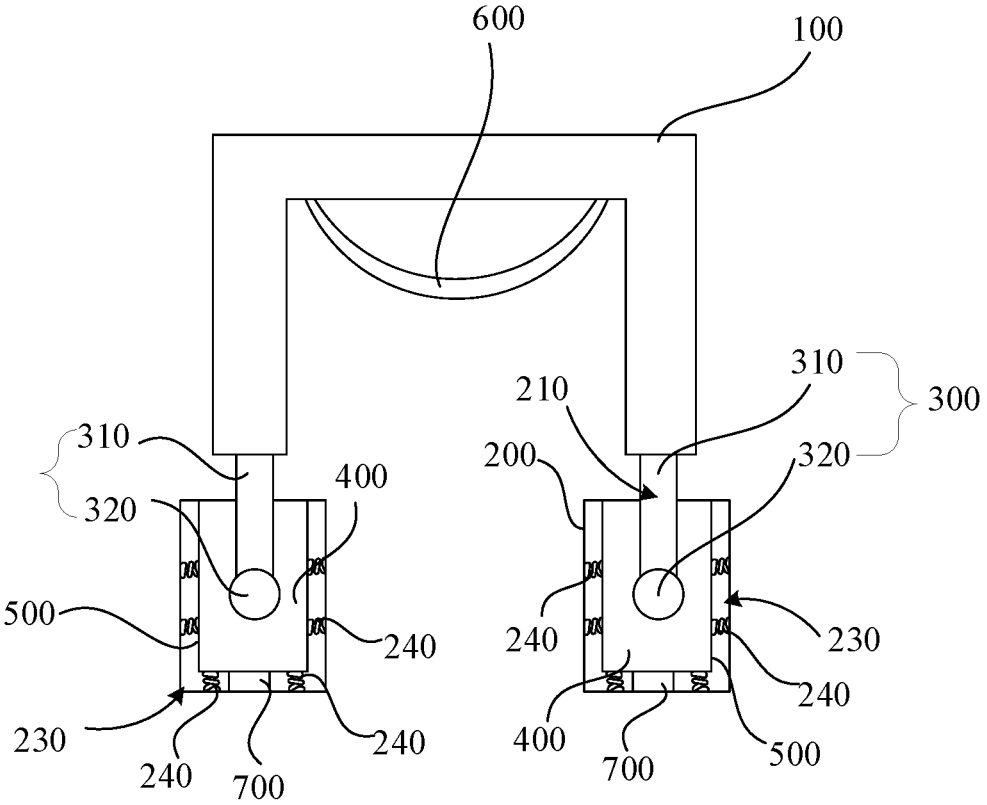
FIG. 1 is a schematic structural view of a walker handle for Parkinson's patients according to an embodiment of the present disclosure.

The realization of the objective, functional characteristics, and advantages of the present disclosure are further described with reference to the accompanying drawings.

DETAILED DESCRIPTION OF THE EMBODIMENTS

The technical solutions in the embodiments of the present disclosure will be clearly and completely described below with reference to the drawings in the embodiment of the present disclosure. Obviously, the described embodiments are only a part of the embodiments of the present disclosure, not all of the embodiments. Based on the embodiments in the present disclosure, all other embodiments perceived by those ordinary skills in the art without creative effort should be fallen within the protection scope of the present disclosure.

It should be noted that all of the directional instructions in the embodiments of the present disclosure (such as, up, down, left, right, front, rear) are only used to explain the relative position relationship and movement of each component under a specific attitude (as shown in the drawings), if the specific attitude changes, the directional instructions will change correspondingly.

Besides, the descriptions in the present disclosure that refer to "first," "second," etc. are only for descriptive purposes and are not to be interpreted as indicating or implying relative importance or to implicitly indicate the number of technical features indicated. Thus, a feature defined as "first" or "second" may explicitly or implicitly include at least one of the features. In addition, technical solutions between the embodiments can be combined with each other, but must be based on the realization of the technical solutions by those skilled in the art, and when the technical solutions are contradictory to each other or cannot be realized, the technical solutions should be considered that the combination does not exist, and the technical solutions are not fallen within the protection scope claimed in the present disclosure.

Parkinson's disease, also known as paralysis agitans, is a chronic disease of the central nervous system that affects the patient's moving ability, which mostly occurs in middle-aged and older people. The main manifestations of the disease in the early stage include static tremor, muscle rigidity, slow movement, difficulty in starting movements and abnormal posture. Static tremor is an uncontrollable shaking of a patient's hands or arms that occurs at rest or worsens with emotional stress.

At present, the walker can be supported by equipment, so that elderly patients with inconvenient legs and feet and the elderly patients who even lose the ability to walk can take care of themselves and go out for a walk like normal people. However, there are no special walkers or walker handles for Parkinson's patients, walkers cannot meet the activity needs of Parkinson's patients, and Parkinson's patients are easy to tremor when using the walkers, which may cause damage to muscle.

Figure 2:
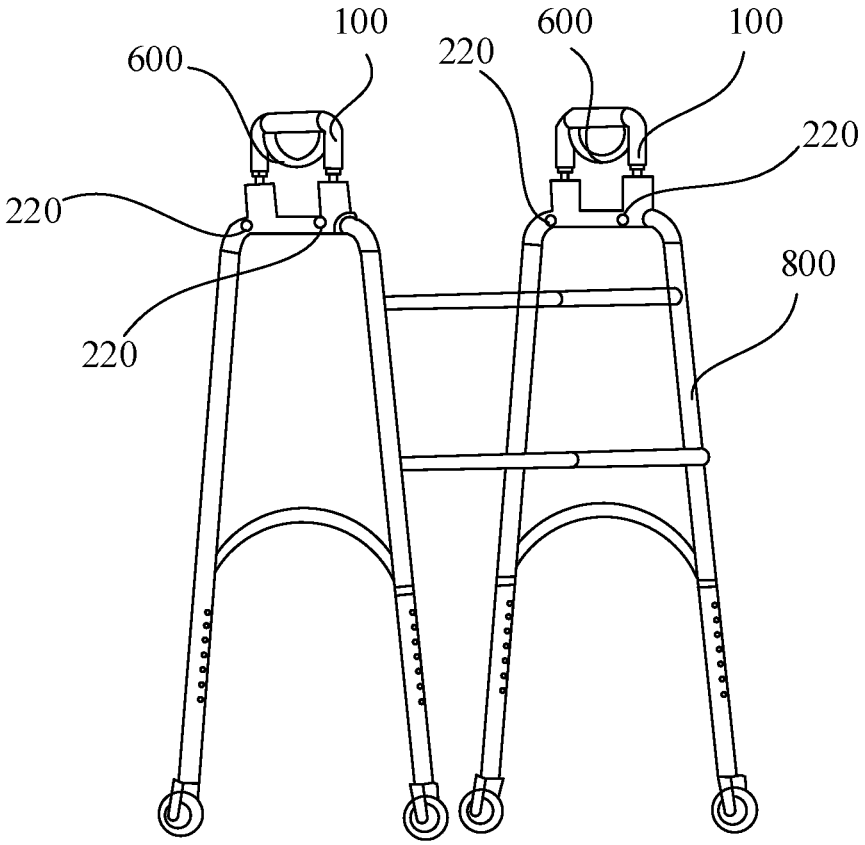
FIG. 2 is a schematic structural view of the walker for Parkinson's patients according to an embodiment of the present disclosure.

As shown in FIG. 1 and FIG. 2, the present disclosure provides a walker handle for Parkinson's patients.

The walker handle for Parkinson's patients includes a handle 100 and a connecting base 200, two ends on both sides of the handle 100 are vertically extended with a connecting rod 300, and the connecting base 200 is installed on a walker body 800, the connecting base 200 is provided with an accommodating chamber, and the accommodating chamber is filled with a buffer 400, the connecting base 200 is provided with a connecting port 210 communicating with the accommodating chamber toward the handle 100, and the connecting rod 300 passes through the connecting port 210 and is wrapped by the buffer 400.

Specifically, in order to ensure that the buffer 400 can maximize the cushion of the pressure transmitted by the handle 100, the buffer 400 can be made into a very thick shape to provide sufficient connecting strength and sufficient cushion force for the connecting rod 300 of the handle 100. In order to prevent Parkinson's patients from trembling too much when using the handle 100, the connecting rod 300 can be separated from the accommodating chamber of the connecting base 200, and the structure around the connecting rod 300 can be extended to exceed a size of the connecting port 210 to prevent the connecting rod 300 from running out of the guarantee structural strength. When the walker needs to be used, the walker handle can be installed on the walker, the Parkinson's patient holds the handle 100 with his hand. When the Parkinson's patient's hand trembles, the connecting rod 300 on the handle 100 is pressed down, and the connecting rod 300 transmits the pressure to the buffer 400, due to the effect of the buffer 400, the buffer 400 will transform the tremor from all directions of the handle 100 into an elastic cushion, and the buffer 400 is compressed and deformed, so that the reaction force transmitted to the trembling hand of the Parkinson's patient can be offset by the cushion, so that the reaction force of the tremor minimizes the muscle damage of the Parkinson's patient As shown in FIG. 1 and FIG. 2, in order to further enhance the elastic change effect, in an embodiment, the walker handle further includes a plastic piece 500, and the plastic piece 500 is provided between an inner wall of the connecting base 200 and an outer wall of the buffer 400, a plurality of springs are connected between an outer wall of the plastic piece 500 and the inner wall of the connecting base 200. It can be understood that a plurality of springs 240 can be connected only between a bottom wall of the plastic piece 500 and a bottom wall of the connecting base 200, while the buffer 400 buffers the pressure of the connecting rod 300 on the handle 100, providing the plurality of springs 240 is more suitable for the pressure generated by the tremors of Parkinson's patients.

As shown in FIG. 1 and FIG. 2, in an embodiment, an accommodation space 230 is enclosed between the outer wall of the plastic piece 500 and the inner wall of the connecting base 200, and a plurality of the springs 240 are evenly distributed in the accommodation space 230. As provided in this way, by evenly distributing a plurality of springs 240 between the outer wall of the plastic piece 500 and the inner wall of the connecting base 200, the tremor caused by the connecting rod 300 on the plastic piece 500 can be buffered from all directions, which further reduces the elastic cushion forces to Parkinson's patients when using a walker.

As shown in FIG. 1 and FIG. 2, in an embodiment, the walker handle further includes a pressure sensor 700 and a display unit, and the pressure sensor 700 is provided between the outer wall of the plastic piece 500 and inner wall of the connecting base 200, and is away from a side of the connecting rod 300, the pressure sensor 700 is used for detecting the pressure of the connecting rod 300 on the plastic piece 500; the display unit is connected to the pressure sensor 700, the display unit is used for displaying a pressure value detected by the pressure sensor 700. It can be understood that the pressure value detected by the pressure sensor 700 can reflect the tremor degree of the Parkinson's patient, and the pressure value detected by the pressure sensor 700 can be transmitted and displayed on the display unit. The display unit may be a display. The Parkinson's patient or the medical staff can infer the tremor degree of the Parkinson's patient by observing the pressure value displayed on the display unit, thereby obtaining the recovery status of the Parkinson's patient.

In an embodiment, the buffer 400 is a back-stick sponge, and the sticking surface of the back-stick sponge is glued to an inner wall of the plastic piece 500. As provided in this way, the bonding effect between the buffer 400 and the inner wall of the plastic piece 500 is improved and the installation stability of the buffer 400 is improved. The elasticity provided by the back-stick sponge can be used to buffer the pressure generated by Parkinson's patients when they use the walker handle, reducing the damage to the patient's muscles. Certainly, in other embodiments, the material of the buffer 400 may be rubber or the like.

As shown in FIG. 1 and FIG. 2, in an embodiment, the connecting rod 300 includes a connecting block 310 and a limiting block 320, the connecting block 310 is connected with the limiting block 320, and the limiting block 320 is provided in a spherical shape. It can be understood that, since the limiting block 320 is provided in the spherical shape, when tremors occur, the spherical limiting block 320 can adapt to Parkinson's patients swinging or trembling in various directions, making the movement of the connecting rod 300 more flexible and further reducing the damage to the muscles.

As shown in FIG. 1 and FIG. 2, since Parkinson's patients tend to tremble when holding the walker handle, in order to ensure the using stability. In an embodiment, the walker handle further includes a bandage 600, the two ends of the bandage 600 are connected to the handle 100, and the bandage 600 is used for tying a human hand to the handle 100. It is understandable that the Parkinson's patient can grasp the walker handle with his hands when using it, and at the same time use the bandage 600 to fix the Parkinson's patient's hand on the walker handle to prevent the Parkinson's hand from being detached due to a tremor.

In order to reduce the compression force of the bandage 600 on the hands of Parkinson's patients, in an embodiment, the bandage 600 is an elastic bandage 600, and the two ends of the elastic bandage 600 are connected with the handle 100 to form a deformable space. It can be understood that the size of each patient's hand is different, and providing the bandage 600 as an elastic bandage 600 can help adapt to the size of the Parkinson's patient's hand and provide a certain compression force, so that the Parkinson's patient can use more comfortably.

As shown in FIG. 1 and FIG. 2, in an embodiment, the connecting base 200 is provided with a screw hole 220, and the screw hole 220 is used for a screwing bolt to install the connecting base 200 on the walker body 800. When the walker handle is installed on the walker, the connecting base 200 can be installed on the walker body 800 through bolts, so as to realize the fixed connection between the walker handle and the walker.

As shown in FIG. 1 and FIG. 2, the present disclosure further provides a walker for Parkinson's patients, which includes a walker handle and a walker body 800 for Parkinson's patients, the walker handle is installed on the walker body 800, and the walker handle includes a handle 100 and a connecting base 200, and two ends on both sides of the handle 100 are vertically extended with a connecting rod 300; and the connecting base 200 is used to be installed on the walker, the connecting base 200 is provided with an accommodating chamber, and the accommodating chamber is filled with a buffer 400; the connecting base 200 is provided with a connecting port 210 communicating with the accommodating chamber toward the handle 100, and the connecting rod 300 passes through the connecting port 210 and is wrapped by the buffer 400. Since the walker for Parkinson's patients adopts all the technical solutions of the above-mentioned embodiments, it also has all the beneficial effects brought by the technical solutions of the above-mentioned embodiments, and will not be repeated here.

The above are only some embodiments of the present disclosure, and do not limit the scope of the present disclosure thereto. Under the inventive concept of the present disclosure, equivalent structural transformations made according to the description and drawings of the present disclosure, or direct/indirect application in other related technical fields are included in the scope of the present disclosure.

What is claimed is:

1. A walker handle for Parkinson's patients, comprising:

a handle;

a connecting base installed on a walker body; and a bandage;

wherein two ends on both sides of the handle are vertically extended with a connecting rod, the connecting base is provided with an accommodating chamber, the accommodating chamber is filled with a buffer, the connecting base is provided with a connecting port communicating with the accommodating chamber toward the handle, and the connecting rod passes through the connecting port and is wrapped by the buffer, and wherein two ends of the bandage are connected to the handle, and the bandage is configured to tie a human hand to the handle.

2. The walker handle of claim 1, further comprising:

a plastic piece, wherein the plastic piece is provided between an inner wall of the connecting base and an outer wall of the buffer, and a plurality of springs are connected between an outer wall of the plastic piece and the inner wall of the connecting base.

3. The walker handle of claim 2, wherein an accommodation space is enclosed between the outer wall of the plastic piece and the inner wall of the connecting base, and a plurality of the springs are evenly distributed in the accommodation space.

4. The walker handle of claim 3, further comprising:

a pressure sensor provided between the outer wall of the plastic piece and the inner wall of the connecting base; and a display unit connected with the pressure sensor, wherein the pressure sensor is away from a side of the connecting rod, and is configured to detect a pressure of the connecting rod on the plastic piece, and the display unit is configured to display a pressure value detected by the pressure sensor.

5. The walker handle of claim 4, wherein the buffer is a back-stick sponge, and the sticking surface of the back-stick sponge is glued to an inner wall of the plastic piece.

6. The walker handle of claim 1, wherein the connecting rod comprises a connecting block and a limiting block, the connecting block is connected with the limiting block, and the limiting block is provided in a spherical shape.

7. The walker handle of claim 1, wherein the bandage is an elastic bandage, and two ends of the elastic bandage are connected with the handle to form a deformable space.

8. The walker handle of claim 1, wherein the connecting base is provided with a screw hole, and the screw hole is used for a screwing bolt to install the connecting base on the walker body.

9. A walker for Parkinson's patients, comprising the walker handle for Parkinson's patients of claim 1 and a walker body, wherein the walker handle is installed on the walker body.

* * * * *